US008220279B2

(12) United States Patent
Do

(10) Patent No.: US 8,220,279 B2
(45) Date of Patent: Jul. 17, 2012

(54) HOME APPLIANCE

(75) Inventor: Joon Young Do, Changwon-si (KR)

(73) Assignee: LG Electronics Inc., Seoul (KR)

( * ) Notice: Subject to any disclaimer, the term of this patent is extended or adjusted under 35 U.S.C. 154(b) by 738 days.

(21) Appl. No.: 12/246,555

(22) Filed: Oct. 7, 2008

(65) Prior Publication Data

US 2009/0090127 A1 Apr. 9, 2009

(30) Foreign Application Priority Data

Oct. 8, 2007 (KR) ..... 10-2007-0100840

(51) Int. Cl.
*F25B 49/00* (2006.01)
*F25B 49/02* (2006.01)

(52) U.S. Cl. ..... 62/127; 62/125; 62/129; 236/51; 236/94

(58) Field of Classification Search ..... 62/125, 62/126, 127, 129; 236/94, 51
See application file for complete search history.

(56) References Cited

U.S. PATENT DOCUMENTS 6,301,100 B1 * 10/2001 Iwata ..... 361/679.55
2003/0041206 A1 * 2/2003 Dickie ..... 710/303
2004/0005044 A1 * 1/2004 Yeh ..... 379/142.01
2004/0216471 A1 * 11/2004 Kim et al. ..... 62/126
2005/0103466 A1 * 5/2005 Landry et al. ..... 165/61
2007/0016852 A1 * 1/2007 Kim et al. ..... 715/513

FOREIGN PATENT DOCUMENTS

KR 10-2005-0043175 A 5/2005
KR 10-2006-0065008 A 6/2006
KR 10-2006-0111072 A 10/2006
KR 10-2007-0055657 A 5/2007
WO WO 2007032644 A2 * 3/2007

* cited by examiner

*Primary Examiner* — Cheryl J Tyler
*Assistant Examiner* — Jonathan Bradford
(74) *Attorney, Agent, or Firm* — Birch, Stewart, Kolasch & Birch, LLP

(57) ABSTRACT

Disclosed is a refrigerator, and more particularly to a refrigerator wirelessly setting functions of the refrigerator by improving a configuration of the refrigerator. The refrigerator according to an embodiment includes a main body formed with a storage chamber, a door rotatably coupled to the main body, a first user interface rotatably coupled to the door, and a second user interface provide on the door, positioned on an rear side of the first user interface, and provided with a receiving unit receiving a wireless signal by an external remote controller.

13 Claims, 7 Drawing Sheets

HOME APPLIANCE

CROSS REFERENCE RELATED APPLICATIONS

The present application claims priority under 35 U.S.C. 119 and 35 U.S.C. 365 to Korean Patent Application No. 10-2007-0100840 (filed on Oct. 8, 2007), which is hereby incorporated by reference in its entirety.

BACKGROUND OF THE INVENTION

1. Field of the Invention

The present invention relates to a refrigerator.

2. Description of the Related Art

Generally, a refrigerator is a home appliance which maintains the temperature of an inside of the refrigerator to be lower than the temperature of a room to enable food in a cold storage or a freezing storage to be preserved for a long time.

A refrigerator has recently been designed to allow a user to watch a television or movies and access to Internet through the refrigerator by having a display device outside the refrigerator, in addition to storing foods inside the refrigerator.

A refrigerator door may have a display device (Avata device) which stores photos or Avata characters and displays the stored data. Information on the refrigerator can be provided or the refrigerator can be controlled through the display device.

In more detail, a refrigerator can display, through the display device, the inside temperature of a refrigerating chamber, the inside temperature of a freezing chamber, and the operation condition (e.g., water, pieces of ice, etc.) using numbers, characters, or icons.

In the prior art, in order to control an operation of a refrigerator, an input button provided on the display device is operated only by approaching a refrigerator door, causing inconvenience to a user.

When the display device is broken or damaged, or detached from the refrigerator for repairing, a problem arises in that an operating control for the refrigeration cannot be performed with ease.

SUMMARY OF THE INVENTION

Accordingly, the present invention is directed to a refrigerator that substantially obviates one or more problems due to limitations and disadvantages of the related art.

An object of the present invention is to provide a refrigerator in which a display device is detachably coupled to the refrigerator and a separate display is provided so that an operation of the refrigerator can be controlled by operating the separate display even when the display device is detached.

Another object of the present invention is to provide a refrigerator whose operating control can be performed with ease by operating a display unit using a remote controller.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with an aspect of the invention, as embodied and broadly described herein, a refrigerator comprises: a main body formed with a storage chamber; a door rotatably coupled to the main body; a first user interface rotatably coupled to the door; and a second user interface provide on the door, positioned on an rear side of the first user interface, and provided with a receiving unit receiving a wireless signal by an external remote controller.

In accordance with another aspect of the invention, a refrigerator comprises: a main body; a door rotatably coupled to the main body; a display unit formed on the door and displaying an operating state of the main body; a control unit controlling the display unit or the main body; a wireless receiving unit provided on the display unit and receiving an external wireless signal transmitted by a remote controller controlling home appliance other than the refrigerator; a memory recorded with control information of the control unit and recorded with a code map matching the wireless signal with a control signal of the main body; and a display device detachably coupled to one side of the display unit.

In accordance with another aspect of the invention, a refrigerator comprises: a main body; a door rotatably coupled to the main body; a display device isolably coupled to the door and displaying an operating state of the main body; a display unit provided in a rear side of the display device and displaying an operating state of the main body in a state that the display device is isolated; an input unit provided on one side of the display unit and allowing a predetermined instruction to be input; and a control unit controlling the main body or the display unit according to the instruction input to the input unit.

With the present invention, even when a display device is isolated from a refrigerator, the refrigerator can be controlled by a separated display device, having an advantage that convenience can be caused to a user.

A display unit of a refrigerator can be controlled by a remote controller used in a TV or an audio, having an advantage that a separated control device is not needed.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DESCRIPTION OF THE PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Hereinafter, the present invention will be described in more detail with reference to the accompanying drawings. However, the present invention may be embodied in different forms by those skilled in the art to which the present invention pertains and should not be construed as limited to the embodiments set forth herein.

Figure 1:
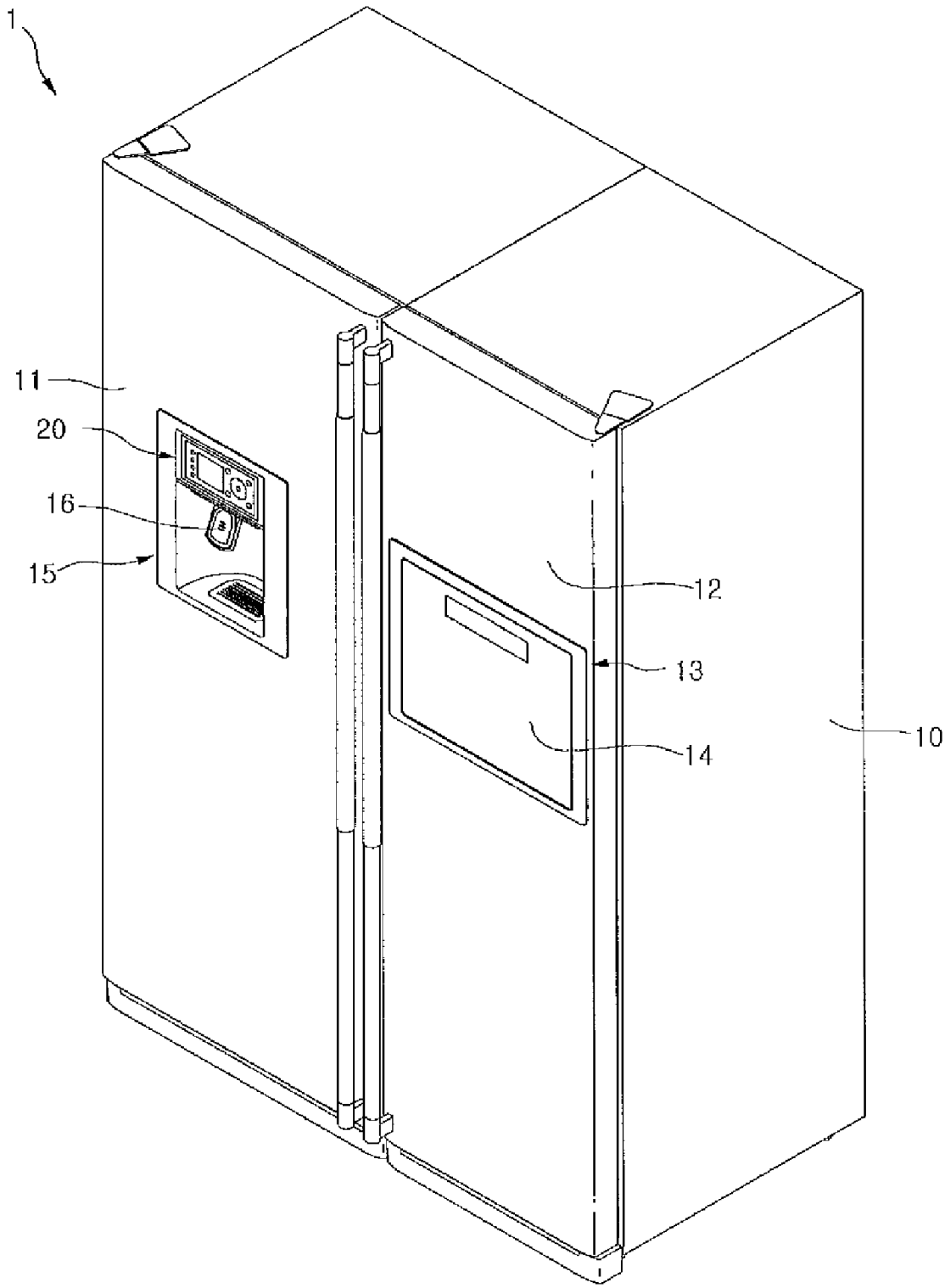
FIG. 1 is a perspective view showing a refrigerator according to an embodiment of the present invention.
Figure 2:
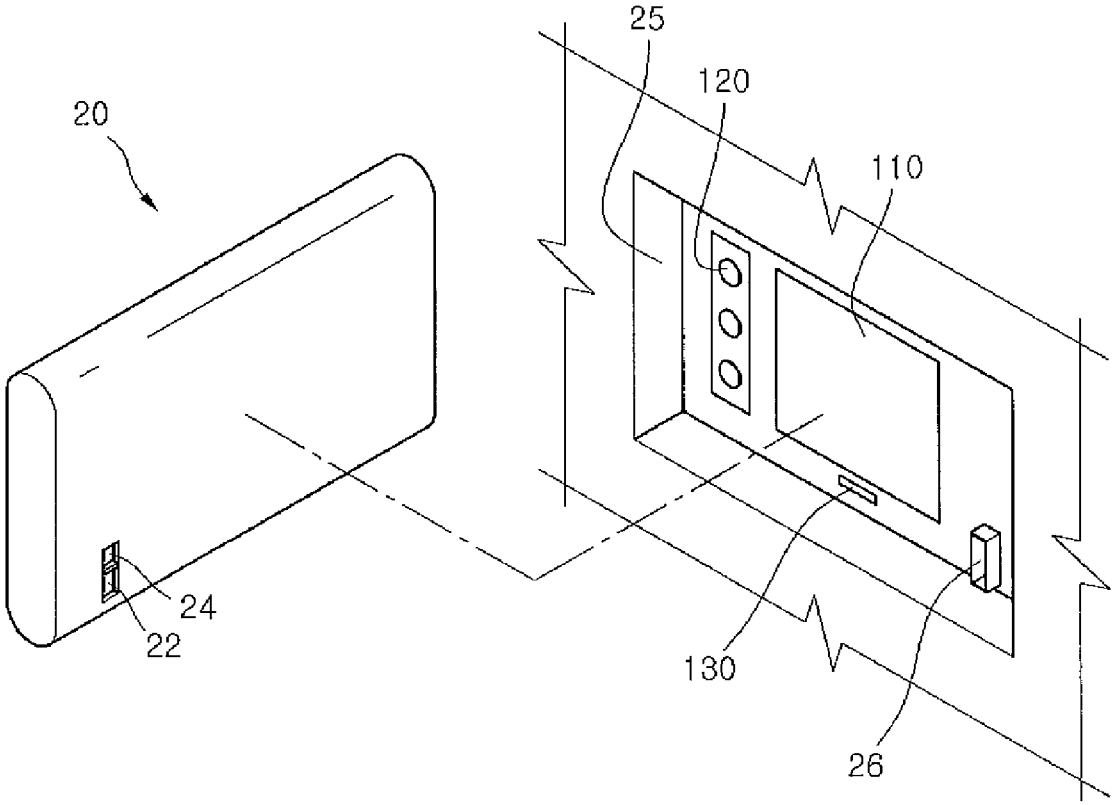
FIG. 2 is a perspective view showing a state that a display device is isolated from a refrigerator according to an embodiment of the present invention.

FIG. 1 is a perspective view showing a refrigerator according to an embodiment of the present invention, and FIG. 2 is a perspective view showing a state that a display device is isolated from a refrigerator according to an embodiment of the present invention.

Referring to FIGS. 1 and 2, the refrigerator 1 according to the embodiment of the present invention includes a main body 10 in which food is stored, and a refrigerator door 11 and a refrigerating door 12 rotatably installed in front of the main body 10 and selectively opening and closing a refrigerating chamber and a freezing chamber, respectively.

Hereinafter, a side by side type refrigerator in which a freezing chamber and a refrigerating chamber are provided to be adjacent to left and right each other will be described by way of example. However, the idea of the present invention is not limited thereto, but may be applied to both a top mount type refrigerator in which a freezing chamber is provided at an upper side of a refrigerating chamber, and a bottom freezer type refrigerator in which a freezing chamber is provided at a lower side of a refrigerating chamber.

More specifically, a home bar 13 which can take out food from the external without opening the refrigerating chamber door 12 is provided on the refrigerating chamber door 12, wherein the home bar 13 includes a home bar door 14. The home bar 13 is opened, only if necessary, making it possible to minimize the outflow of cold air.

A dispenser device 15 which can take out ice or water from the external of the refrigerator 1 is provided on the freezing chamber door 11, wherein the dispenser device 15 includes a take-out lever 16. Although not shown, an ice making device which makes ice or a water tank which stores water may be provided on the freezing chamber door 11.

A display device 20 which displays a photo or a moving picture is provided in front of the freezing chamber door 11. The display device 20 may be rotatably coupled to the freezing chamber door 11. The display device 20 may also be rotatably coupled to the refrigerating chamber door. Hereinafter, a configuration that the display device 20 is detached from the door will be described in detail with reference to the drawings. A case that the display device 20 is provided on an upper front of the dispenser device 15 will be described by way of example.

More specifically, the dispenser device 15 is depressed into the refrigerating chamber door 11. Water or ice is taken out through a take-out port (not shown) by operation of the take-out lever 16.

Here, an operation state of the refrigerator may be displayed on the display device 20. A memory is built-in inside the display device 20, wherein avatar characters or photos or moving picture files stored by a user may be stored in the memory. The display device 20 may have a plurality of input units through which a user can operate the operation state of the refrigerator.

In other words, the display device 20 may have the display unit displaying a screen and the input units through which a user input. Therefore, the display device 20 may be referred to as a user interface.

More specifically, a coupling part 25 to which the display device 20 is coupled is formed on the freezing chamber door 11. The coupling part 25 is depressed from the front surface of the freezing chamber door 11 to the rear of the freezing chamber door 11.

A connection terminal 26 which connects the refrigerator 1 to the display device 20 is provided on the coupling part 25. A connection part 22 connected to the connection terminal 26 is formed on the rear surface of the display device 20.

A shielding cover 24 which shields the connection part 22 is formed on the display device 20. The shielding cover 24 is provided slidably provided on the display unit 20.

When the display device 20 is isolated from the freezing chamber door 11, the shielding cover 24 thus shields the connection part 22 to prevent foreign substances from flowing into the connection terminal 26.

When the display device is connected to the connection terminal 26, the display device 20 may be supplied with power from the refrigerator 1. In other words, when the display device 20 is coupled to the refrigerator 1, a battery provided in the display device 20 may be charged.

When the connection part 22 is connected to the connection terminal 26, information between the display device 20 and the refrigerator 1 may be transmitted/received. When the display device 20 is coupled to the refrigerator 1, an operation condition of the refrigerator 1 may be input to the display device 20.

Meanwhile, a user may use the display device 20 as a portable device, being isolated from the refrigerator 1. In other words, the display device 20 may include a portable wireless display device, for example, a display device capable of receiving a digital multimedia broadcasting (DMB) service.

While the display device 20 being isolated, a display unit 110 which displays the operation state of the refrigerator 1 and an input unit 120 which inputs the operation condition of the refrigerator 1 or the screen set of the display unit 110 are provided on one side of the coupling part 25. Here, a plurality of input buttons may be provided in the input unit 120.

The display unit 110 and input unit 120 may be considered as units through that a user operates so as to operate the refrigerator, and thus may be referred to as a first user interface. Hereinafter, the display device 20 is referred to as a first user interface, and the display unit 110 and input unit 120 including a receiving unit 130 to be described later will be referred to as a second user interface.

Here, the input unit and display unit of the display device 20 may be referred to as a first input unit and a first display unit. Meanwhile, the input unit 120 and display unit 110 may be referred to as a second input unit and a second display unit.

More specifically, when the display device 20 is coupled to the refrigerator 1, the display unit 110 may be automatically turned off OFF, and when the display device 20 is isolated from the refrigerator 1, the display unit 110 may be automatically turned on ON.

In other words, when the display device 20 is coupled to the coupling part 25, a control unit of the refrigerator recognizes the fact to control the display unit 110 to be turned off.

When the display device 20 is coupled to the coupling part 25, the rear surface of the display device 20 may be spaced from the display unit 110 so that the display device 110 is protected.

The coupling part 25 includes a receiving unit 130 which receives a predetermined signal (instruction) from a remote controller (to be described later) in order to control the operation of the refrigerator 1 at a long distance or display photos or moving picture files stored in the main body 10.

In the present embodiment, a case that the display unit 110, input unit 120 and receiving unit 130 are formed on the coupling part 25 is described. However, a separate cover which selectively shields the coupling part 25 and is slidable may be provided, wherein the auxiliary display unit 110 and input unit 120 may be formed on the cover.

In this case, the coupling part 25 is shielded by the cover while the display device 20 is isolated, so that the coupling part 25 may not be exposed.

With the configuration described above, even when a user brings the isolated display device 20, the operation state of the refrigerator can be displayed through the display unit 110, having an advantage that convenience of use can be improved.

Figure 3:
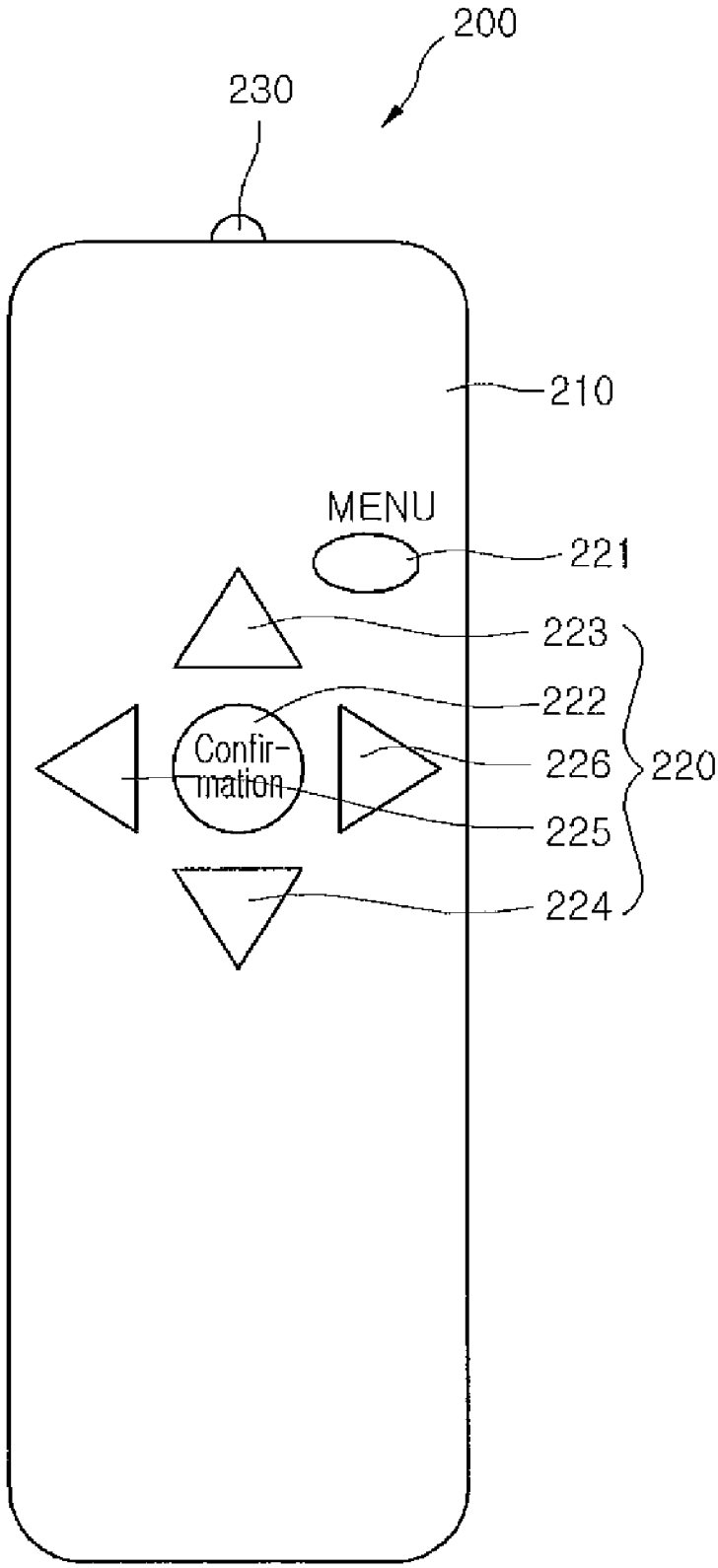
FIG. 3 is a front view showing a remote controller according to an embodiment of the present invention.

FIG. 3 is a front view showing a remote controller according to an embodiment of the present invention Referring to FIG. 3, the remote controller 200 according to the embodiment of the preset invention includes a body part 210 which forms an exterior, a button part 220 provided on the body part 210 and allowing a user to control the operation of the refrigerator 1, and a transmitting unit 230 provided on at least one side of the body part 210 provided on at least one side of the body part 210 and transmitting a predetermined instruction signal from the remote controller 200 to the display unit 110.

More specifically, the button part 220 includes a menu button part 221 which allows a user to select his or her desired menu through the display unit 110, upper movement button part 223, lower movement button part 224, left movement button part 225 and right movement button 226 which allow the user to move into his or her desired menu among the menu on the display unit 110 displayed by operating the menu button part 221, and a confirmation button part 222 which allows the user to select the menu while the user moves into his or her desired menu. Here, the button part 220, in which an instruction is input, may be referred to as an "input unit" of the remote controller 200.

The button part 220 may be constituted in a button type or a touch screen type, so that the user may easily operate the button part 220.

The remote controller 200 is the same as a remote controller used in a general TV, VTR or VCR, wherein infrared ray wavelength and a PCM operation method are used.

Here, the PCM refers to Pulse Code Modulation. In other words, if a predetermined instruction is inputted using the button part 220, the instruction is coded as a binary code and the code is transmitted to the display unit 110 by means of the infrared ray wavelength. The receiving unit 130 then receives and recombines the signal to transfer it to a control unit (to be described later) of the refrigerator main body 10.

The remote controller 200 may be an exclusive device controlling only the display unit 110. Alternatively, the remote controller 200 may be a remote controller controlling channels, volumes, and the like of a TV or audio (radio) used in general household. In this case, the remote controller 200 should of course be switched so that the TV or audio (radio) and the display unit 110 are controlled simultaneously.

Figure 4:
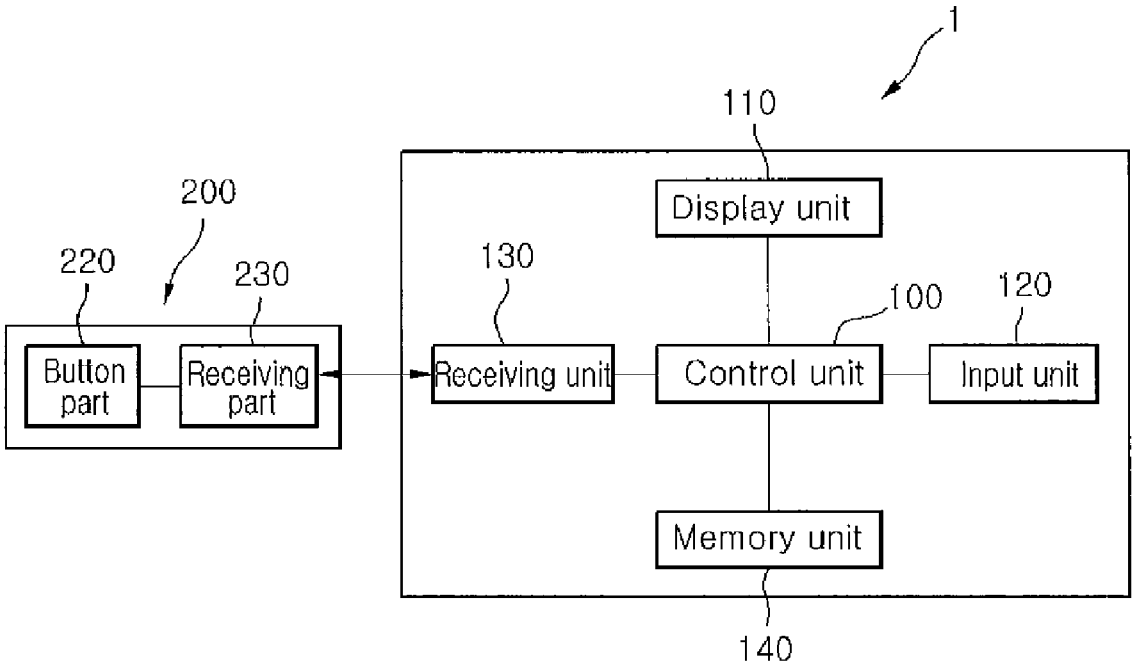
FIG. 4 is a block diagram showing a configuration of a refrigerator and a remote controller according to an embodiment of the present invention.

FIG. 4 is a block diagram showing a configuration of a refrigerator and a remote controller according to an embodiment of the present invention.

Referring to FIG. 4, the refrigerator 1 according to the embodiment of the present invention includes a receiving unit 130 which receives a predetermined signal from the remote controller 200, a control unit 100 which receives the signal from the receiving unit 130 to recognize it as a predetermined instruction, and controls an operation of the refrigerator 1 and a screen of the display unit 110, an input unit 120 connected to the control unit 100 and allowing a user to input a predetermined instruction, a display unit 110 which displays the signal or instruction input through the receiving unit 130 or input unit 120 on the screen, and a memory unit 140 which stores avatar characters, characters and icon information for operating the refrigerator and a user's photos or moving pictures, displayed through the display unit 110.

The remote controller 200 which transmits a predetermined instruction or signal to the refrigerator 1 includes a plurality of button parts 220 through which the user inputs a predetermined instruction, and transmitting unit 230 which converts the instruction input through the button parts 220 into a code and transmits the code to the receiving unit 130.

Hereinafter, a process that the refrigerator 1 operates through the remote controller 200 will be described in detail.

First, when a user is desired to operate the display unit 110 using the remote controller 200, he or she may input his or her instruction by pressing the button part 220. For example, the button part 220 may be pressed in order to display a menu by operating a menu button part 221, move to a desired menu by operating at least one of the movement button parts 223, 224, 225, 226, or select a desired menu by operating the confirmation button part 222.

As described above, as the button part 220 is pressed, a sensor (not shown) built-in the remote controller 200 recognizes the press, a predetermined instruction is coded, and the code signal is transmitted to the receiving unit 130 through the transmitting unit 230.

The receiving unit 130 then transmits the signal to the control unit 100, the control unit 100 recognizes the signal as a predetermined instruction, and displays a screen meeting the instruction on the display unit 110. At this time, the avatars, photos or moving pictures displayed on the display unit 110 stored in the memory unit 140 are displayed on the display unit 110 by means of an instruction of the control unit 100.

Meanwhile, home appliances controlled by the remote controller may include a TV, a DVD player, a washing machine, an air-conditioner, an oven, or the like, in addition to the refrigerator 1. In other words, diverse forms of home appliances can be controlled by the remote controller 200 and the remote controller 200 and the respective home appliances may be considered as forming a single control system.

In other words, the operating relation between the refrigerator and remote controller in the drawing may be applied to other home appliances.

More specifically, the home appliance may include a receiving unit which receives a signal transmitted from the remote controller, a control unit which controls the signal received by the receiving unit to be decoded and the functions thereof, and a memory which stores the control information by the control unit being coded as a code map (data map).

It will be described in detail with reference to Table 1 set forth below.

TABLE 1

| Function | Control Code (Remote Controller) | Control Signal (Home Appliance) |
|---|---|---|
| Setting of Menu | 0001 | 01 |
| Control of Channel (up) | 0010 | 02 |
| Control of Channel (down) | 0011 | 03 |
| Control of Volume (up) | 0101 | 04 |
| Control of Volume (down) | 0110 | 05 |
| Setting of Direction (up) | 1000 | 06 |

TABLE 1-continued

| Function | Control Code (Remote Controller) | Control Signal (Home Appliance) |
|---|---|---|
| Setting of Direction (down) | 1001 | 07 |
| Setting of Direction (left) | 1010 | 08 |
| Setting of Direction (right) | 1011 | 09 |
| Input of time | 1100 | 10 |
| Setting of Temperature (up) | 1101 | 11 |
| Setting of Temperature (down) | 1111 | 12 |

More specifically, the above Table 1 shows an embodiment of a plurality of code maps which control the home appliances by transmitting/receiving signals between the remote controller 200 and the home appliances according to the functions of the respective home appliances. Here, the code map may stored in one or more memory chip of the memory unit of each home appliance.

The remote controller 200 may be provided with a plurality of button parts 220 related to functions and operations of the home appliances.

More specifically, the button part may include buttons for setting a menu, controlling channels, controlling volumes, setting directions for moving into a menu to be selected, inputting a time or setting a temperature of a home appliance to be controlled. The button part may also include buttons for other functions according to sorts of home appliances, in addition to the functions described above.

More specifically, when any one of button parts is input using the remote controller 200, the remote controller 200 recognizes a control code corresponding to the input content and transmits the control code to the home appliance.

The home appliance then recognizes the control code as a preset control signal and allows the function of the home appliance corresponding to the preset control signal to be controlled.

Here, the control code and control signal described above are one embodiment, but these may be varied according to sorts of home appliances and be set as different values when manufacturing the code map to be stored.

Figure 5A:
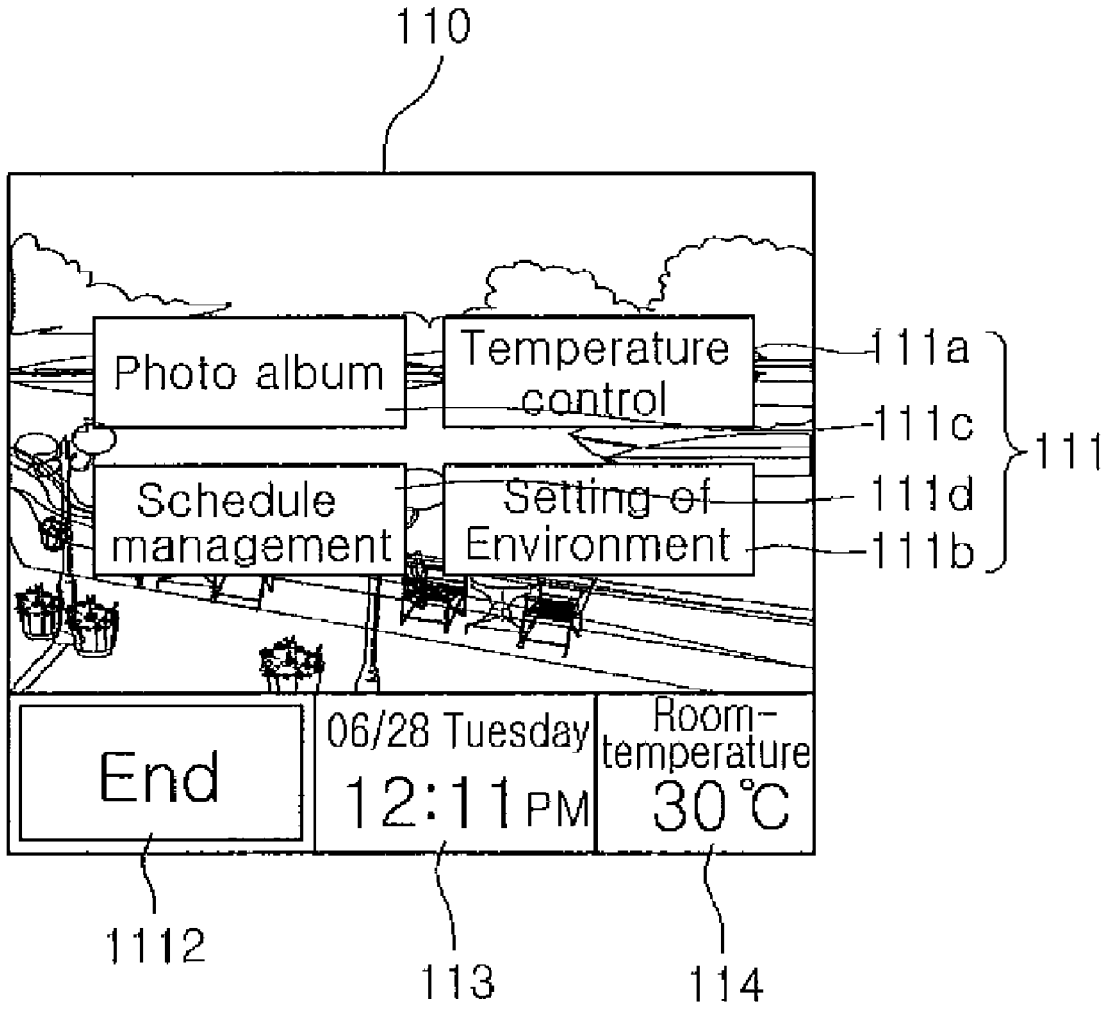
FIGS. 5A, 5B and 5C are views showing a screen display process of a display unit according to an embodiment of the present invention.
Figure 5B:
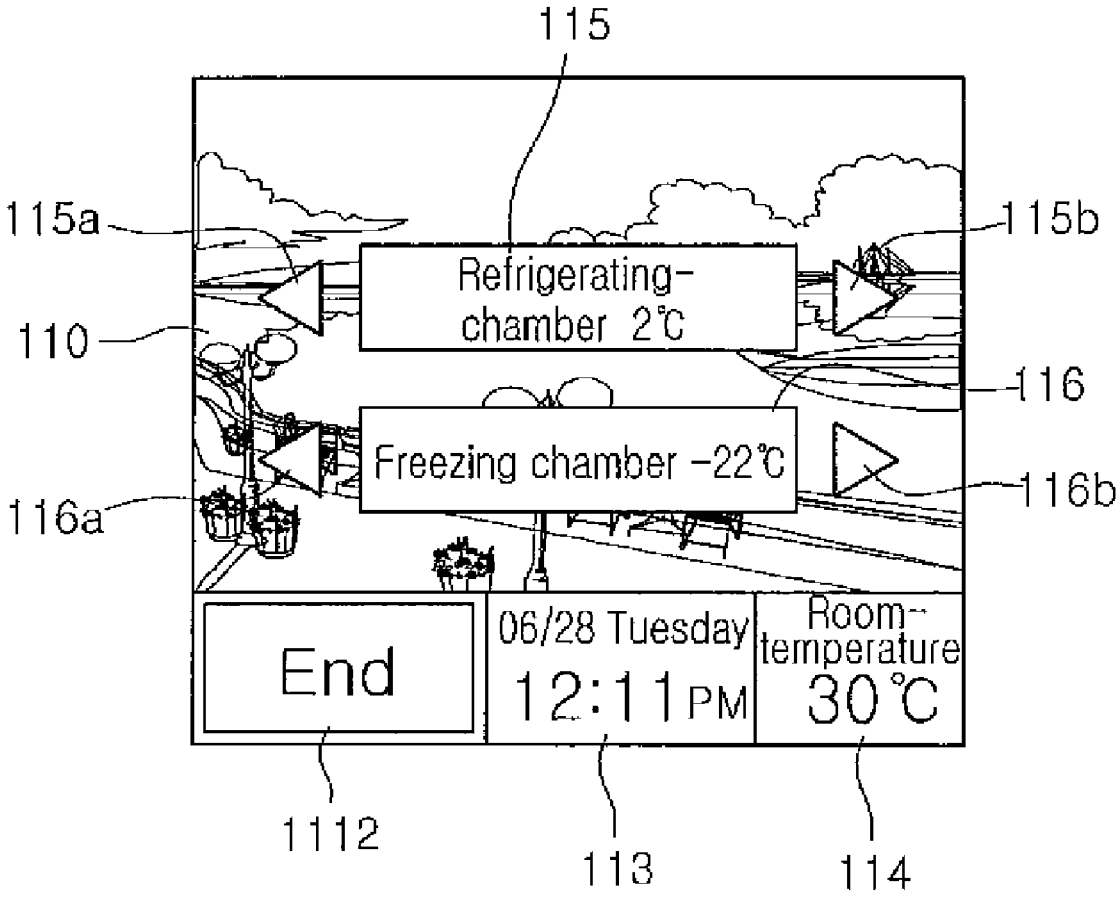
Figure 5C:
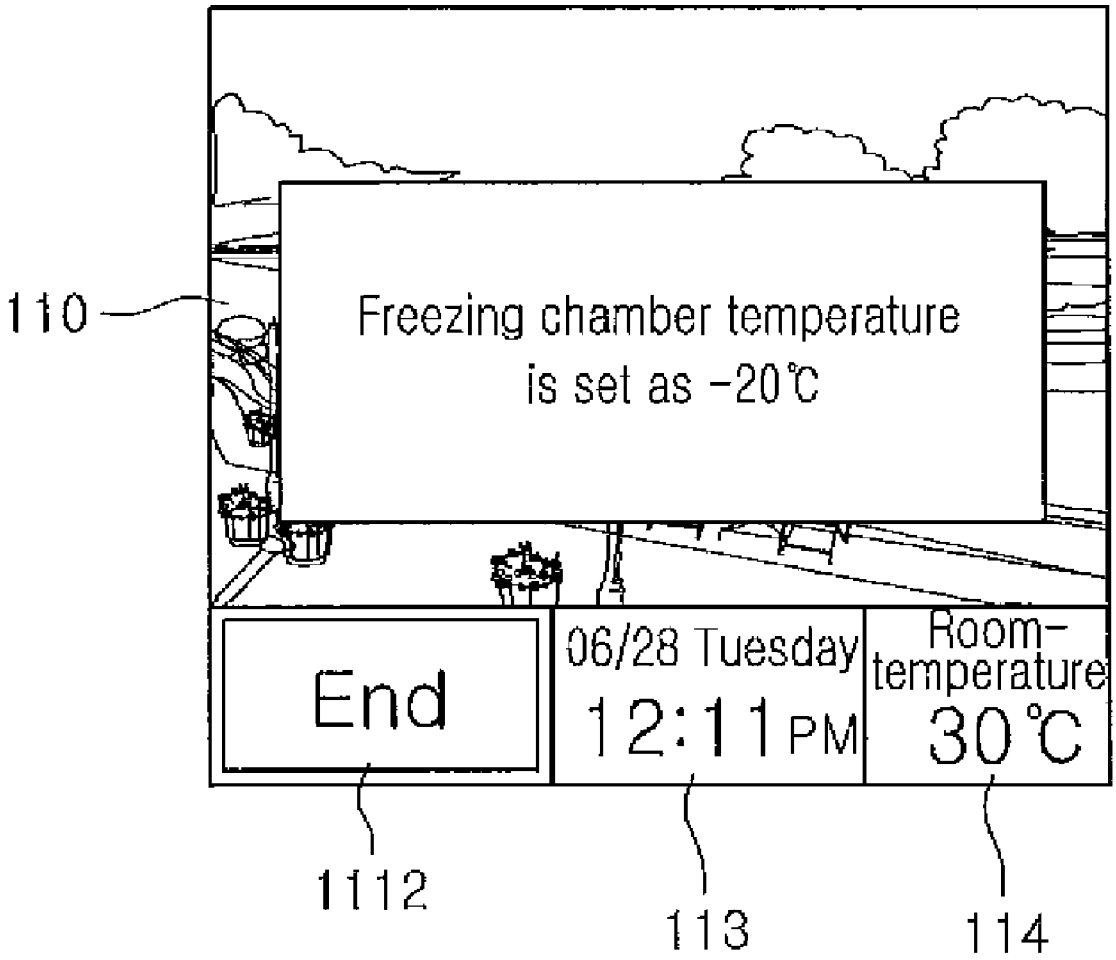

FIGS. 5A, 5B and 5C are views showing a screen display process of a display unit according to an embodiment of the present invention.

Referring to FIGS. 5A, 5B and 5C, a process that a temperature control is selected from a setting menu and a temperature of a refrigerating chamber or a freezing chamber is set is displayed on a display unit 110 according to an embodiment of the present invention.

A screen configuration to be displayed on the display unit 110 will be described below, however, when the display device 20 is coupled to a refrigerator door, the same screen will be displayed on the display device 20.

More specifically, a process of setting a temperature according to the drawings may be implemented by a input unit 120 formed on the coupling part 25 or the remote controller 200.

Hereinafter, a process that a menu is displayed and set by the remote controller 200 and a desired menu is selected will he described.

First, when an initial screen (displaying a photo or an avatar character) is set on the display unit 110, if a user presses a menu button part 221 of the remote controller 200, a signal transfer is made through the transmitting unit 230 and receiving unit 130.

Then, as shown in FIG. 5A, a setting menu 111 is displayed on the display unit 110. The setting menu 111 includes a temperature control unit 111*a* which controls a temperature of a refrigerating chamber or a freezing chamber of a refrigerator, an environment set unit 111*b* which sets a basic environment regarding an image, volume or the like of the screen of the display unit 110, a photo album unit 111*c* which stores or displays a user's photo or moving picture, and a schedule management unit 111*d* which inputs the user's individual schedule and displays the schedule at the appropriate time.

At a lower side of the setting menu 111, an ending set unit which ends the operation of the display unit 110, a time display unit 113 which displays the current time, and a temperature display unit 114 which displays a room temperature outside the refrigerator.

In the initial state, any one of the setting menu 111 may be in an active state.

In this state, a user may make the temperature control unit 111*a* an active menu using a button part 220 of the controller 200, and select the temperature control unit 111*a* pressing the confirmation button part 222.

Also, the setting menu, ending set unit 112, time display unit 113 and temperature display unit 114 may of course be made in a touch screen type, in order that a user can easily operate them. In this case, the user may touch the temperature control unit 111*a* in order to control a temperature of a freezing chamber or a refrigerating chamber.

Then, as shown in FIG. 5B, a refrigerating chamber setting unit 115 and a freezing chamber setting unit 116 are displayed on the display unit 110. The refrigerating chamber temperature (2° C.) currently set is displayed on the refrigerating chamber setting unit 115, and the freezing chamber temperature (−22° C.) currently set is displayed on the freezing chamber setting unit 116.

Rise setting units 115*b*, 116*b* and fall setting units 115*a*, 115*b* which can raise or fall the refrigerating chamber temperature or the freezing chamber temperature are displayed on both sides of the refrigerating setting unit 115 and freezing chamber setting unit 116.

In this state, the use may select the refrigerating chamber setting unit 115 or the freezing chamber setting unit 116 using an upper movement button part 223 or a lower movement button part 224 of the remote controller 200.

More specifically, a first control code map which can designate any one of the refrigerating chamber and freezing chamber may be stored in the memory unit 140. A control code by means of the input of the remote controller 200 and a control signal data matching with the control code and recognizing any one of the refrigerating chamber and the freezing chamber may be stored in the first control code map.

In this state, if data is input through a button part of the remote controller 200, the input data is coded and a code signal is transmitted to the receiving unit 130. Then, the control unit 100 determines a control signal matching with the code signal according to the data stored in the first control code map to control the refrigerating chamber or the freezing chamber to be selected. In other words, the control unit 100 allows a freezing chamber or a refrigerating chamber whose temperature is to be controlled to be selected.

Next, the user may reset the refrigerating chamber temperature or the freezing chamber temperature using a left movement button part 225 or a right movement button part 226.

After selecting the freezing chamber setting unit 116, if the freezing chamber temperature is reset as −20° C., characters "Refrigerating chamber temperature is set as −20° C." are displayed on the display unit 110.

In other words, in this case, a second control code map that the refrigerating chamber temperature or the freezing chamber temperature is reset and displayed may be stored in the memory unit 140. And, the second control code map may include a control code by means of the input of the temperature setting (up, down) button of the remote controller 200, and a control signal data matching with the control code and recognizing the temperature setting (up, down) operation.

In this state, if the temperature setting (up, down) is input through the remote controller 200, the input content is coded and a code signal is transmitted to the receiving unit 130. Then, the control unit 100 determines a control signal matching with the code signal according to the data stored in the second control code map to control the temperature setting function to be selected. In other words, the control unit 100 enables a freezing chamber or a refrigerating chamber to control its temperature.

When the operation control of the refrigerator is completed as described above, it is possible to return to the initial screen of the display unit 110 by selecting the ending set unit 112.

Meanwhile, although not shown in the drawings, at least one menu of the setting menu 111 other than the temperature control of the refrigerator 1, that is, a photo album unit 111*c* which manages and stores a user's individual image, a schedule management unit 111*d* which stores the user's individual schedule and displays the schedule, or an environment set unit 111*b* which sets a basic environment of the display unit 110, is selected, so that it may be managed and set through the display unit 110 in the same manner described above.

With the configuration described above, the refrigerator can be remotely controlled using a TV or an audio (radio) remote controller used in household, making it possible to provide convenience to a user.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A refrigerator, comprising:

a main body formed with a chamber;

a door coupled to the main body;

a coupling part provided on one of the main body and the door, the coupling part provided with a receiving unit receiving a wireless signal, a first display unit configured to display an operating state of the refrigerator, a first input unit configured to input a command, and a first connection part;

a wireless device detachably coupled to the coupling part, the wireless device including:

a second display unit configured to display an operating state of the refrigerator;

a second input unit configured to input a command; and a second connection part formed on a rear surface of the wireless device to connect to the first connection part, the second connection part configured to be supplied with power from the refrigerator when the wireless device is coupled to the coupling part.

2. The refrigerator as claimed in claim 1, wherein the wireless device includes a portable display device.

3. The refrigerator as claimed in claim 1, wherein at least one of the first display unit and the second display unit can display one of the following:

a photo album mode in which an image stored in the main body is displayed;

a temperature control mode in which temperature of the main body is controlled; and a schedule management mode in which a schedule preset by a user is managed.

4. The refrigerator as claimed in claim 1, wherein when the wireless device is coupled to the main body or the door, the operating state of the refrigerator is displayed on the second display unit.

5. The refrigerator as claimed in claim 1, wherein when the wireless device is detached from the main body or the door, the operating state of the refrigerator is displayed on the first display unit.

6. A refrigerator, comprising:

a main body;

a door coupled to the main body;

a coupling part formed on one of the main body and the door;

a display device detachably coupled to the coupling part;

a display unit formed on the coupling part, the display unit configured to display an operating state of the main body when the display device is separated from the coupling part and configured to be covered by the display device and powered off when the display device is connected to the coupling part; a control unit controlling the display unit or the main body;

a receiving unit provided on the display unit and receiving an external signal transmitted by a remote controller controlling an other home appliance; and a memory recorded with control information of the control unit and recorded with a code map matching the signal with a control signal of the main body.

7. The refrigerator as claimed in claim 6, wherein the coupling part is depressed backward to be coupled with the display device.

8. The refrigerator as claimed in claim 6, wherein the coupling part is provided with a connection terminal allowing information transmission/receiving between the main body and the display device to be performed.

9. The refrigerator as claimed in claim 8, wherein the display device further includes:

a connecting unit being connected to the connection terminal; and a shielding cover shielding the connection part.

10. The refrigerator as claimed in claim 6, wherein the other home appliance includes at least one of a TV, an audio, a DVD player, an air conditioner, and a washing machine.

11. The refrigerator as claimed in claim 6, wherein the memory includes:

a first control code map designating a refrigerating chamber or a freezing chamber; and a second control code map designating rising or falling of a temperature of the refrigerating chamber or a temperature of the freezing chamber.

12. The refrigerator as claimed in claim 11, wherein the first control code map and second control code map includes:

a control code based on the external signal; and a control signal of the control unit, matching with the control code.

13. The refrigerator of claim 6, wherein the display device is configured to control an operation of a TV.

* * * * *